US008975566B2

(12) United States Patent
Black et al.

(10) Patent No.: US 8,975,566 B2
(45) Date of Patent: Mar. 10, 2015

(54) FIN BUZZ SYSTEM AND METHOD FOR ASSISTING IN UNLOCKING A MISSILE FIN LOCK MECHANISM

(75) Inventors: Thomas A. Black, Tucson, AZ (US); David J. Reyes, Tucson, AZ (US); Robert W. Von Mayr, Sahuarita, AZ (US); Erik A. Fjerstad, Tucson, AZ (US); John D. Willems, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 128 days.

(21) Appl. No.: 13/570,280

(22) Filed: Aug. 9, 2012

(65) Prior Publication Data

US 2014/0042266 A1 Feb. 13, 2014

(51) Int. Cl.
*F42B 15/01* (2006.01)
*F42B 10/64* (2006.01)

(52) U.S. Cl.
CPC ..... *F42B 10/64* (2013.01)
USPC ..... 244/3.24; 244/3.28

(58) Field of Classification Search
USPC ..... 244/3.24, 3.27, 3.28, 3.29
See application file for complete search history.

(56) References Cited

U.S. PATENT DOCUMENTS 4,173,322 A 11/1979 Macdonald
4,603,594 A 8/1986 Grimm
4,795,110 A 1/1989 Lang
4,884,766 A 12/1989 Steinmetz et al.
5,551,793 A 9/1996 Lewis
5,950,963 A 9/1999 Speicher et al.
6,073,880 A 6/2000 Voigt et al.
6,250,584 B1 6/2001 Hsu et al.
6,352,217 B1 3/2002 Hsu et al.
6,450,444 B1 9/2002 Sorvino
7,316,370 B2 1/2008 Sankovic et al.
2002/0179778 A1 * 12/2002 Pijaca et al. ..... 244/221
2007/0007383 A1 * 1/2007 Hsu et al. ..... 244/3.24
2009/0114763 A1 * 5/2009 Geck et al. ..... 244/3.24
2009/0218437 A1 * 9/2009 Sirimarco et al. ..... 244/3.21
2012/0025007 A1 * 2/2012 Geswender ..... 244/3.2

* cited by examiner

*Primary Examiner* — Philip J Bonzell
*Assistant Examiner* — Nicholas McFall
(74) *Attorney, Agent, or Firm* — Renner, Otto, Boisselle & Sklar, LLP

(57) ABSTRACT

By removing the aerodynamic fin forces from the fin lock mechanism, achieved by actuating the fin control system to apply a controlled force that counters the aerodynamic forces acting on the control fins, the system can reduce the transmission of aerodynamic forces onto the fin lock mechanism, which makes the fin lock mechanism easier to unlock with less force. Accordingly, a method for unlocking a fin lock mechanism that releasably holds one or more missile control fins in a locked position, where the control fins are prevented from rotating, includes the steps of (i) applying an alternating positive and negative rotational force to a control fin; (ii) monitoring the position of the control fin during the applying step; and (iii) while the position of the control fin does not exceed a predetermined value, repeating the applying step for a predetermined number of times or for a predetermined period.

17 Claims, 3 Drawing Sheets

FIN BUZZ SYSTEM AND METHOD FOR ASSISTING IN UNLOCKING A MISSILE FIN LOCK MECHANISM

FIELD OF THE INVENTION

The invention relates to a mechanism for locking in place the steering fins of a missile, particularly when the missile is not in use, and more particularly to a system and method for assisting in unlocking the fin lock mechanism.

BACKGROUND

A typical missile includes pairs of controllable steering fins disposed on opposite sides of a missile fuselage. The fins are rotatable to provide yaw, pitch, and roll control during missile flight. The fins are coupled to rotatable shafts that extend into the fuselage and engage corresponding control systems, generally through motors and associated gear linkages, that control the rotation of the fins.

Accurate flight of the missile depends on the proper function of the steering fins, and it is desirable to avoid damage to the control systems when the missile is carried external to an aircraft or during handling prior to mounting on the aircraft. Locking the steering fins in place when the missile is not in use prevents control fin rotation and reduces the possibility of damage and wear on the steering fins and related fin control systems. At the same time, the steering fins must be quickly and reliably released so that they can perform their steering function when the missile is launched.

SUMMARY OF THE INVENTION

The same aerodynamic forces on the control fins, that the fin lock mechanism prevents or minimizes transfer to the steering control system, can generate forces in the fin lock mechanism that make the fin lock mechanism much more difficult to unlock. The present invention removes the aerodynamic fin forces from the fin lock mechanism by actuating the fin control system to apply a controlled force that counters the aerodynamic forces acting on the control fins. Consequently, the system and method provided by the invention reduce the forces acting on the fin lock mechanism, thereby making the fin lock mechanism easier and more reliable to unlock. The system and method provided by the invention includes a sensor for monitoring the position of the fin control shaft, and thus the fin, to confirm whether the fin has been unlocked.

More particularly, the system and method provided by the invention "buzz" the fins when the fin lock mechanism is asked to unlock the fins. This means that a control signal is sent to a motor in the control system that controls rotation of the fin, which causes the motor to attempt to rotate the fin alternately clockwise and counterclockwise with limited torque for a short period. A sensor is used to monitor the position of the motor shaft. The fin has been successfully unlocked if the motor shaft rotates more than a predetermined amount. If after a predetermined time the motor shaft has not rotated more than the predetermined amount, the fin has not unlocked and the missile is deemed to be inoperative. This can mean that the missile should not be launched, should be disabled, or that testing has failed and the missile requires maintenance.

Accordingly, the present invention provides a method for unlocking a fin lock mechanism that releasably holds one or more missile control fins in a locked position where the control fins are prevented from rotating. The method includes the steps of (i) applying an alternating positive and negative rotational force to a control fin; (ii) monitoring the position of the control fin during the applying step; and (iii) while the position of the control fin does not exceed a predetermined value, repeating the applying step a predetermined number of times or for a predetermined period.

The present invention also provides a system for assisting in unlocking a fin lock mechanism that releasably holds one or more missile control fins in a locked position where the control fins are prevented from rotating. The system includes (i) means for applying an alternating positive and negative rotational force to a control fin (such as a motive device and a control shaft coupled to the control fin, the motive device being operative to selectively rotate the control shaft); (ii) means for monitoring the position of the control fin (such as a rotational position sensor); and (iii) means for controlling the applying means to apply the rotational force while the position of the control fin does not exceed a predetermined value, and controlling the applying means to apply the rotational force a predetermined number of times or for a predetermined period (such as a microprocessor-based programmable controller).

Similarly, the present invention provides a system that includes a motor operatively connected to the control fin to selectively rotate the fin about a fin axis to provide steering capability under the control of a motor control signal, and a controller that generates the motor control signal by executing a motor control logic routine. The motor control signal includes a series of sequential values corresponding to instructions to the motor to apply an alternating positive and negative rotational force to the control fin.

Such a system may further include a fin lock mechanism; a sensor for detecting the position of the control fin; and a control shaft coupled to a control fin for controllably rotating the control fin about a fin axis. The fin lock mechanism includes a locking piston that is axially movable along a piston axis transverse the fin axis, and the control shaft and the piston include corresponding features that cooperate to lock the control shaft to prevent the control fin from rotating. The controller is in communication with the motor and the sensor. The controller generates the motor control signal to directionally oscillate the control shaft while attempting to unlock the control shaft by causing the locking piston to move axially, away from the control shaft, to minimize the force required to move the locking piston to unlock the control fin.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

Figure 1:
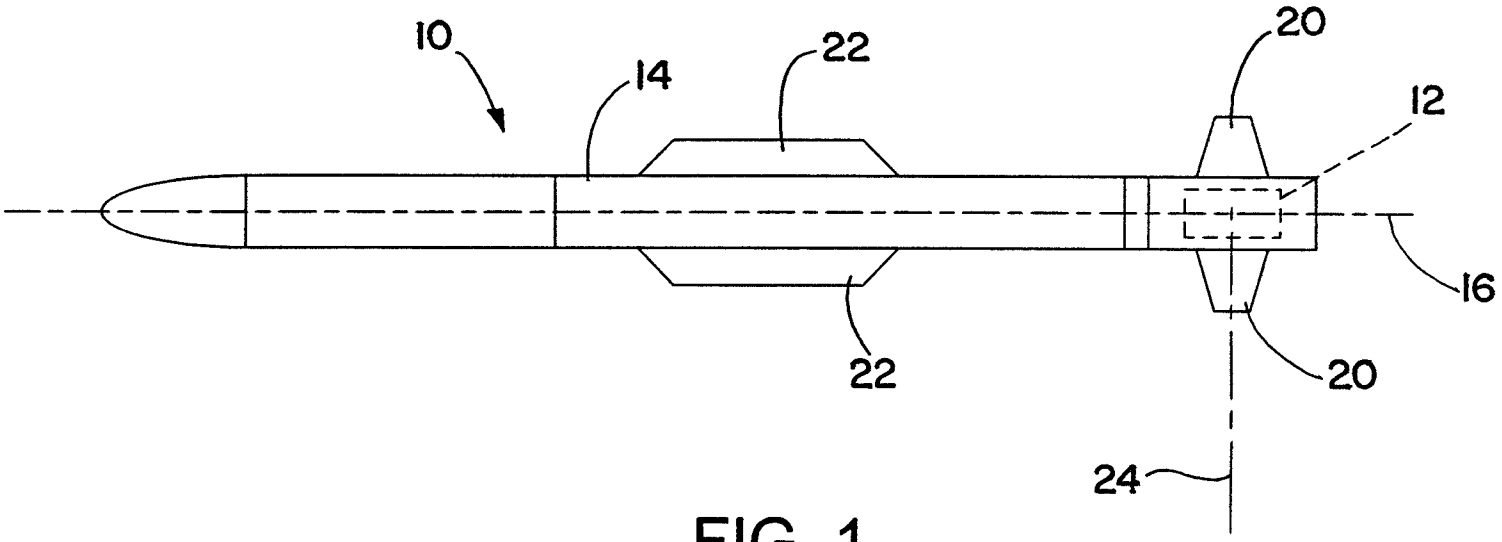
FIG. 1 is a schematic representation of a missile incorporating a system provided by the present invention.
Figure 2:
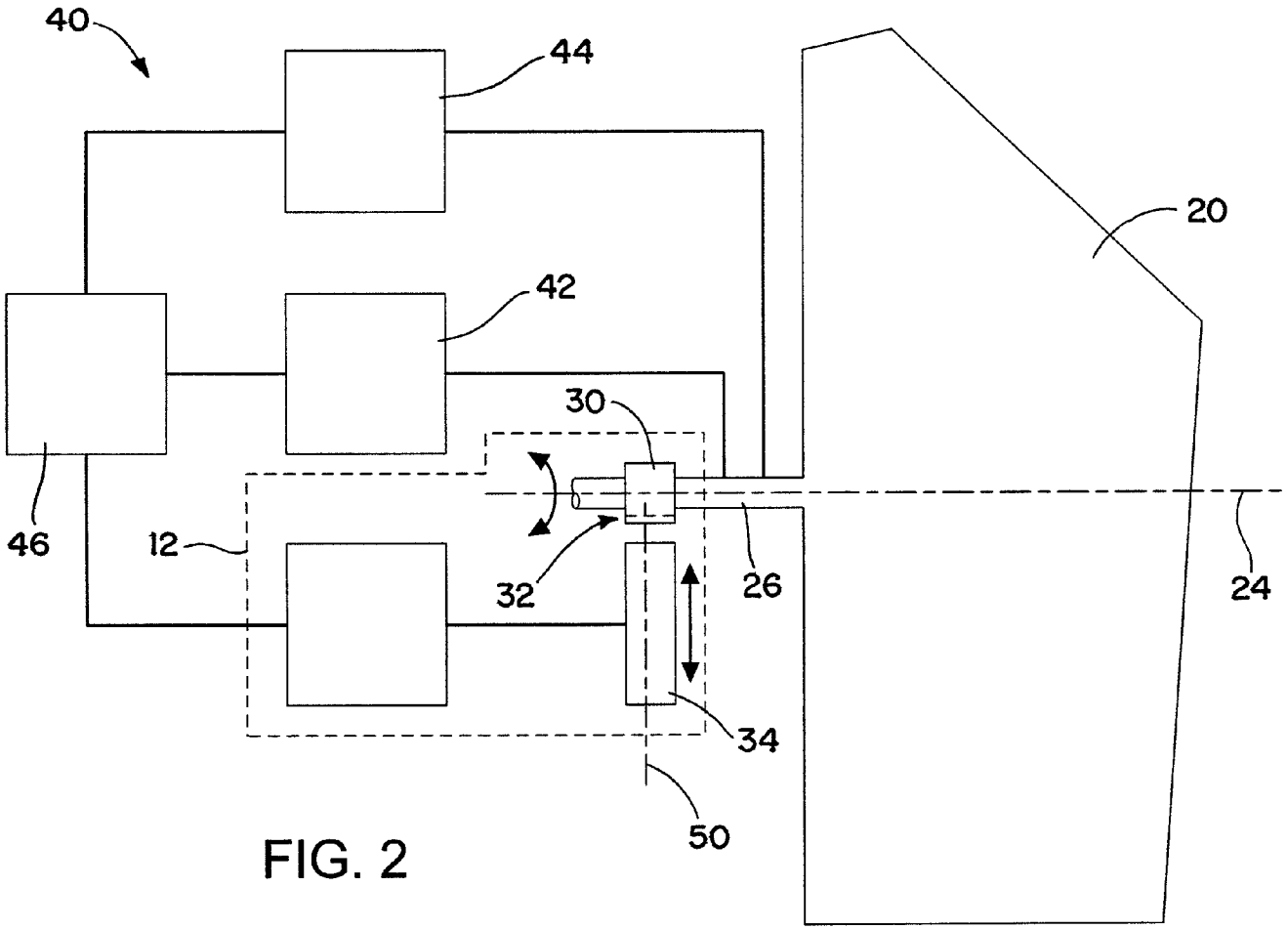
FIG. 2 is a schematic representation of an exemplary system provided in accordance with the present invention.

Referring now to the drawings in detail, and initially to FIGS. 1 and 2, an example of a missile 10 is shown in which a fin lock mechanism or fin lock assembly 12 provided by the invention may be employed. The missile 10 generally has a cylindrical body 14 with a longitudinal axis 16. Multiple fins 20 and 22 extend from the surface of the body 14, typically paired on opposing sides of the body 14, to help control the missile's path during its flight. In particular, the missile 10 includes a plurality of movable steering control fins 20 toward a rear end of the missile 10 that are rotatable about a fin axis 24 transverse the longitudinal axis 16, and typically perpendicular to the longitudinal axis 16.

A typical steering control fin 20 has an output shaft 26 that extends from the fin 20 and into the missile body 14. The output shaft 26 defines the fin axis 24. Rotating this shaft 26 controls the attitude of the steering control fin 20 relative to the longitudinal axis 16 of the missile 10. In other words, the control shaft 26 coupled to a control fin 20 for controllably rotating the control fin 20 about the fin axis 24.

The plurality of steering control fins 20 can each be held in a locked, unmoving condition by the fin lock mechanism 12. The fin lock mechanism 12 includes a fin lock piston 34. The control shaft 26 and the piston 34 include corresponding features that cooperate to lock the control shaft 26 to prevent the control fin 20 from rotating. In the illustrated embodiment, referring now to FIGS. 2 and 3, each of the control fins 20 are connected to the fin lock mechanism 12 by a respective fin lock bracket 30 secured to or incorporated into the output shaft 26. The fin lock bracket 30 has a locking recess or detent 32 for receipt of a corresponding portion of the fin lock piston 34. When the piston 34 extends into the recess 32 in the fin lock bracket 30, the output shaft 26, and thus the control fin 20, is locked in place and prevented from rotating. Alternatively, the piston may have a notch or recess for receipt of a protrusion formed by the fin lock bracket 30, the output shaft 26, or the fin 20 itself. The piston 34 is retractable to allow the fin lock bracket 30, and thus the output shaft 26 and the control fin 20, to rotate. Examples of fin lock mechanisms that can use the present invention are disclosed in commonly-owned U.S. patent application Ser. No. 13/554,032, filed on Jul. 20, 2012, titled RESETTABLE MISSILE CONTROL FIN LOCK ASSEMBLY, and which is incorporated herein by reference.

The present invention provides a system 40 for assisting in unlocking a fin lock mechanism 12 that releasably holds one or more missile control fins 20 in a locked position. In the locked position, the control fins 20 are prevented from rotating in such a manner as to control the flight of the missile 10, which in practical terms, due to tolerance variations, for example, generally means preventing the control fins 20 from rotating more than a predetermined value. An exemplary predetermined value is approximately 0.83 degrees. This can mean, for example, that the control fin 20 cannot rotate more than about 0.83 degrees. In this example, if the control fin 20 can rotate more than 0.83 degrees, then the control fin 20 generally will be in an unlocked position.

The system 40 includes (i) means for applying an alternating positive and negative rotational force to the control fin 20 (such as a motive device 42); (ii) means for monitoring the position of the control fin 20 during the applying step (such as a position sensor 44); and (iii) means for controlling the applying means to apply the rotational force while the position of the control fin 20 does not exceed the predetermined value, and controlling the applying means to apply the rotational force a predetermined number of times or for a predetermined period (such as a controller 46).

The applying means includes the motive device 42 and the control shaft 26 coupled to the control fin 20, the motive device 42 being operative to selectively rotate the control shaft 26. The motive device 42 can be a solenoid or an electric motor, for example. The monitoring means includes a rotational position sensor 44, which can monitor the position of the output shaft 26 directly, or can monitor the position of a shaft of the motor 42 as an estimate of the position of the output shaft 26. Such a latter type of sensor 44 can be incorporated into the motor 42. The controlling means includes the controller 46, such as a microprocessor-based programmable controller. The controller 46 signals the fin lock mechanism 12 to unlock the control fin 20. This includes outputting a signal to the motive device 42 to attempt to rotate the control fin 20. During the unlocking process the controller 46 signals the motive device 42 to rotate the control fin 20 with predetermined torque, typically a torque that is less than the torque applied to rotate the control fin 20 during flight of the missile 10.

Accordingly, the system 40 provided by the invention can be described as including (i) a motor 42 operatively connected to the control fin 20 to selectively rotate the fin 20 about the fin axis 24 to provide steering capability under the control of a motor control signal, and (ii) a controller 46 that generates the motor control signal by executing a motor control logic routine. The motor control signal can include a series of sequential values corresponding to instructions to the motor 42 to apply an alternating positive and negative rotational force to the control fin 20.

The system 40 can further include one or more of (iii) the fin lock mechanism 12, and (iv) the position sensor 44 for detecting the position of the control fin 20. The fin lock mechanism 12 includes the locking piston 34, which is axially movable along a piston axis 50 transverse the fin axis 24 to engage the control fin 20 and prevent it from rotating. The controller 46 is in communication with the motor 42 and the sensor 44. The controller 46 generates the motor control signal to directionally oscillate the control shaft 26 while attempting to unlock the control shaft 26 by causing the locking piston 34 to move axially, away from the control shaft 26. The control shaft 26 is rotated to reduce the aerodynamic forces acting on the control fin 20. When the control shaft 26 is rotated counter to the forces acting on the control fin 20, this reduces or minimizes the force required to move the locking piston 34 to unlock the control fin 20.

To unlock the control fins 20, the controller 46 outputs a signal directing the motor 42 to move the fins 20 for a predetermined time while monitoring the fin position via the sensor 44. In other words, the controller 46 controls the control fin 20 in accordance with one or more inputs from the sensor 44.

Accordingly, a method provided by the invention generally includes the steps of applying a rotational force to the control fin 20 while monitoring the position of the control fin 20. The controller 46 "buzzes" the control fins 20 when attempting to unlock the fin lock mechanism 12. This means that a control signal is sent to the motor 42 in the control system that controls rotation of the fin 20, which causes the motor 42 to attempt to rotate the fin 20 alternately clockwise and counterclockwise until the control fin 20 rotates a predetermined distance or a predetermined period has elapsed. The control signal is referred to as a buzz profile, an example of which is shown in the following Table.

Output Shaft Unlock Buzz Command

| CHANNEL NUMBER | COMMAND |
|---|---|
| 1 | $+1.325 \times \sin(50 \times 2\pi \times \tau + 25 \times \pi/180)$ DEG |
| 2 | $-1.325 \times \sin(50 \times 2\pi \times \tau + 25 \times \pi/180)$ DEG |
| 3 | $\lvert 1.325 \times \sin(50 \times 2\pi \times \tau \rvert 25 \times \pi/180)$ DEG |
| 4 | $-1.325 \times \sin(50 \times 2\pi \times \tau + 25 \times \pi/180)$ DEG |

If the control fin 20 moves a predetermined distance, the fin 20 is unlocked. If the control fin 20 does not move the predetermined distance, the applying step is repeated for a predetermined period or a predetermined number of times or a combination thereof. If the control fin 20 has not moved the predetermined distance after the predetermined period or predetermined number of tries, the attempt to unlock the control fin 20 has failed.

Thus if the predetermined distance value is 0.83 degrees, then if the achieved output shaft positions of all axes during the predetermined period are greater than 0.83 degrees or less than −0.83 degrees, then the output shafts 26 are assumed to have been unlocked, the fin lock mechanism 12 is disabled, de-energized, or otherwise maintained in an unlocked position. The controller 46 can then control the orientation of the control fins 20 to control the missile's roll, pitch, and yaw. But if the predetermined period, such as 500 milliseconds, elapses without the output shaft positions of all fin axes achieving positions greater than 0.83 degrees or less than −0.83 degrees, one or more control fins 20 have not unlocked. The missile 10, whether mounted on an aircraft, launched, or in a test stand, is considered defective and will not be activated, and if possible will be repaired before being returned to service.

More particularly, the present invention provides a method for unlocking a fin lock mechanism that releasably holds one or more control fins in the locked position. One method provided by the invention includes the steps of (i) applying an alternating positive and negative rotational force to a control fin; (ii) monitoring the position of the control fin during the applying step; and (iii) while the position of the control fin does not exceed a predetermined value, repeating the applying step a predetermined number of times or for a predetermined period.

Additionally, the applying step can include outputting a signal to or otherwise signaling the motive device 42, such as a motor, that is coupled to the control fin 20 to rotate the control fin 20 alternately clockwise and counterclockwise. The method can further include the step of indicating a failure after the repeating step is complete and the position of the control fin 20 has not exceeded the predetermined value. If during the monitoring step the position of the control fin exceeds the predetermined value, the method can include the step of stopping the applying step.

The applying step includes the controller outputting a predetermined signal profile with a predetermined amplitude. The control signal typically has a varying positive and negative amplitude. An exemplary signal profile is a 50 Hz sine wave with an amplitude of 1.325 degrees.

The predetermined period can be calculated to ensure that the repeating step occurs at least three times. Specifically, the repeating step allows the applying step to apply rotational force to cause the control fin to rotate alternately no more than three times clockwise and no more than three times counterclockwise. The repeating step only occurs, however, when the monitoring step detects rotation of the control fin of less than 0.83 degrees, positive or negative. The controller determines that the control fin is unlocked when the sensor detects rotation of at least 0.83 degrees.

The applying step includes applying a predetermined torque. After the monitoring step detects movement of the control fin in excess of the predetermined value, the method can further include the step of rotating the control fin to provide flight control using a torque that is greater than the torque applied during the applying step.

The method also can include the step of moving a piston 34 to engage the control fin 20, including via the control shaft 26, to prevent the control fin 20 from rotating; as well as the step of disengaging a fin lock mechanism 12 from connection to the control fin 20.

Figure 3:
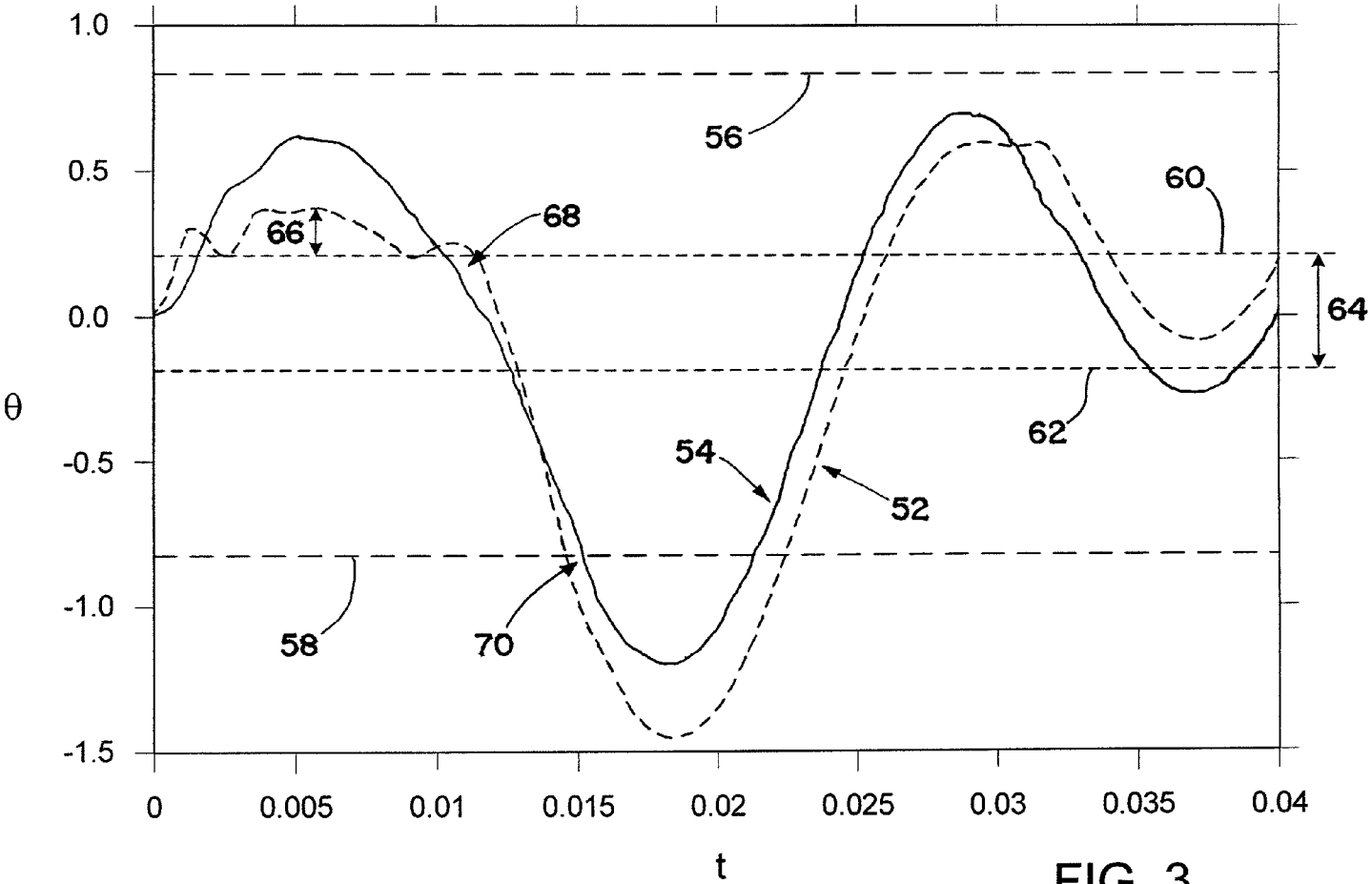
FIG. 3 is a graphical representation of a sensed motor shaft position and fin output shaft position over time.

A graphical illustration of the sensed motor shaft position and fin output shaft 26 position over time is shown in FIG. 3. This graph shows the angular position 52 of the output shaft 26, representing the position of the fin 20, and the angular position 54 of the shaft of the motor 42 as reported by the motor's position sensor 44. The graph also shows the upper and lower unlocked threshold values 56 and 58, and typical upper and lower fin lock limits 60 and 62, based on an estimated worst-case estimate 64 of tolerances that determine how far the output shaft 26 can rotate in the locked condition.

As shown in the graph, at about time 0.005 second (indicated by arrow 66), the motor 42 pushes against the fin lock piston 34 (FIG. 2), increasing the load on the fin lock mechanism 12, making it difficult to unlock. At about 0.010 second, the motor 42 reduces the load on the fin lock mechanism 12, making it easier to unlock the control fin 20, as shown at 68. And as shown at 70, at about 0.015 second, the sensed motor position exceeds the predetermined unlock threshold value of −0.83 degrees, indicating that the control fin 20 is unlocked and available to assist in controlling the flight of the missile 10.

In summary, by removing the aerodynamic fin forces from the fin lock mechanism 12, achieved by actuating the fin control system to apply a controlled force that counters the aerodynamic forces acting on the control fins 20, the system can reduce the transmission of aerodynamic forces onto the fin lock mechanism 12, which makes the fin lock mechanism 12 easier to unlock with less force. Accordingly, a method for unlocking a fin lock mechanism 12 that releasably holds one or more missile control fins 20 in a locked position, where the control fins 20 are prevented from rotating, includes the steps of (i) applying an alternating positive and negative rotational force to a control fin 20; (ii) monitoring the position of the control fin 20 during the applying step; and (iii) while the position of the control fin 20 does not exceed a predetermined value, repeating the applying step for a predetermined number of times or for a predetermined period.

Although the invention has been shown and described with respect to a certain illustrated embodiment, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the illustrated embodiment of the invention.

We claim:

1. A method for unlocking a fin lock mechanism that releasably holds one or more missile control fins in a locked position where the control fins are prevented from rotating, the method comprising the steps of:

initiating application of a force to rotate a missile control fin to a desired orientation;

detecting the failure of the control fin to rotate to the desired orientation;

following foregoing initiating and detecting steps, applying an alternating positive and negative rotational force to the control fin;

monitoring the position of the control fin during the applying step; and until the position of the control fin exceeds a predetermined value, repeating the applying step a predetermined number of times or for a predetermined period.

2. A method as set forth in claim 1, comprising the step of indicating a failure after the repeating step is complete and the position of the control fin has not exceeded the predetermined value.

3. A method as set forth in claim 1, where if during the monitoring step the position of the control fin exceeds the predetermined value, stopping the applying step.

4. A method as set forth in claim 1, where the predetermined value is approximately 0.83 degrees.

5. A method as set forth in claim 1, comprising the step of moving a piston to engage a control fin to prevent the control fin from rotating.

6. A method as set forth in claim 1, where the applying step includes outputting a predetermined signal profile with a predetermined amplitude.

7. A method as set forth in claim 6, where the outputting step includes outputting a signal profile that is a 50 Hz sine wave with an amplitude of 1.325 degrees.

8. A method as set forth in claim 1, where the repeating step occurs at least three times.

9. A method as set forth in claim 1, where the repeating step allows the applying step to apply rotational force to cause the control fin to rotate alternately no more than three times clockwise and no more than three times counterclockwise.

10. A method as set forth in claim 1, where the repeating step only occurs when the monitoring step detects rotation of the control fin of less than 0.83 degrees.

11. A method as set forth in claim 1, where the applying step includes outputting a signal to a motive device that is coupled to the control fin.

12. A method as set forth in claim 1, where the applying step includes applying a predetermined torque.

13. A method as set forth in claim 1, where after the monitoring step detects movement of the control fin in excess of the predetermined value, comprising the step of rotating the control fin to provide flight control using a torque that is greater than the torque applied during the applying step.

14. A method as set forth in claim 1, comprising the step of disengaging a locking device from connection to the control fin.

15. A system for assisting in unlocking a fin lock mechanism that releasably holds one or more missile control fins in a locked position where the control fins are prevented from rotating, the system comprising:

a motor operatively connected to the control fin to selectively rotate the fin about a fin axis;

a sensor capable of detecting the position of the control fin; and a controller in communication with the motor and the sensor, the controller being configured to generate a first motor control signal to rotate the control fin to a desired orientation;

where, in response to a signal from the sensor indicating that the control fin did not rotate to the desired orientation in response to the first motor control signal, the controller being configured to generate a second motor control signal to direct the motor to directionally oscillate the control fin in opposing positive and negative directions until the control fin rotates more than a predetermined value or until the motor has applied a force to the control fin a predetermined number of times or for a predetermined time.

16. A system as set forth in claim 15, comprising a fin lock mechanism;

a control shaft coupled to a control fin for controllably rotating the control fin about a fin axis;

where the fin lock mechanism includes a locking piston that is axially movable along a piston axis transverse the fins axis;

where the control shaft and the piston include corresponding features that cooperate to lock the control shaft to prevent the control fin from rotating; and where the controller generates the motor control signal to directionally oscillate the control shaft while attempting to unlock the control shaft by causing the locking piston to move axially, away from the control shaft, to minimize the force required to move the locking piston to unlock the control fin.

17. A system as set forth in claim 15, where the second control signal includes a series of sequential values corresponding to instructions to the motor to apply an alternating positive and negative rotational force to the control fin.

* * * * *